United States Patent [19]

Isom

[11] 4,105,015

[45] Aug. 8, 1978

[54] EXHAUST HOOD ENERGY SAVING DEVICE

[75] Inventor: William C. Isom, 9430 Folkstone, Dallas, Tex. 75220

[73] Assignee: William C. Isom, Dallas, Tex.

[21] Appl. No.: 775,781

[22] Filed: Mar. 9, 1977

[51] Int. Cl.[2] ..... F24C 15/20; F23J 11/00

[52] U.S. Cl. ..... 126/299 D; 55/DIG. 36; 98/43 A

[58] Field of Search ..... 126/299 D; 55/DIG. 36; 98/115 R, 43 A; 236/DIG. 9

[56] References Cited

U.S. PATENT DOCUMENTS

| | | | |
|---|---|---|---|
| 2,182,106 | 12/1936 | Ames | 126/299 D |
| 2,326,957 | 8/1943 | Maguire | 98/43 A |
| 3,188,937 | 6/1965 | Mieczkowski | 98/43 A |
| 3,251,290 | 5/1966 | Jensen et al. | 126/299 D |
| 3,332,621 | 7/1967 | Tanner | 236/11 |
| 3,625,135 | 12/1971 | Carlson | 126/299 D |
| 3,690,245 | 9/1972 | Ferlise et al. | 126/299 D |
| 3,826,180 | 7/1974 | Hayashi | 98/43 A |
| 3,834,295 | 9/1974 | Seidel | 126/299 D |

*Primary Examiner*—Ronald C. Capossela
*Attorney, Agent, or Firm*—Richards, Harris & Medlock

[57] ABSTRACT

The specification discloses an exhaust ventilation system with a vented hood arrangement over a cooking area which is controlled automatically by the presence of a cook at a cooking station. The primary exhaust fan is automatically turned off a predetermined period of time after the cook has left the cooking station. A fresh air fan is similarly controlled by the presence of the cook at the cooking station. An auxiliary exhaust fan is automatically energized and deenergized in response to the operation of the primary exhaust fan, such that the auxiliary fan is on when the primary exhaust fan is off and vice versa.

15 Claims, 2 Drawing Figures

EXHAUST HOOD ENERGY SAVING DEVICE

BACKGROUND OF THE INVENTION

The process of grilling or frying food produces by-products from the cooking process such as smoke and odors which are conventionally removed through an exhaust ventilation system. In a commerical cooking establishment, the exhaust ventilation system generally includes a vented hood extending over the area in which the food is grilled or fried and an exhaust fan motor for drawing the smoke and the like from the vented hood and up through the ventilation ducting to the exterior of the building.

The conventional ventilation exhaust system described above draws a considerable quantity of air from the interior of the building along with the unwanted cooking odors and smoke. As a result, the air heated or cooled by the air conditioning system of the building is also exhausted to the outside, causing the thermostat of the air conditioner to run the air conditioning system to replace the exhausted air. The resultant inefficient operation of the air conditioning system creates an added expense of operation for the owner of the building through higher utility bills, and more importantly it needlessly wastes valuable energy.

Numerous attempts have been made in the past to overcome these difficulties associated with an exhaust ventilation system. One approach has been to install a fresh air blower with an exhaust vent located near the cooking station, so that a quantity of outside air is blown into the cooking area to be exhausted along with the smoke and odors instead of the building's air conditioning. Such a system has proven unsatisfactory in periods of extreme hot or cold outside temperatures, since the introduction of such air into the interior of the building offsets the air conditioning system causing it to run more often and consume more energy.

Other systems have been heretofore developed for automatically operating a cooking area ventilation system in response to detecting smoke or particles emitted from the cooking area, such as U.S. Pat. Nos. 3,625,135 and 3,826,180. Other exhaust fan systems have been devised which are automatically operable in response to a pressure sensitive switch in the gas burner for the cooking stove, U.S. Pat. No. 2,182,106. However, such prior devices are not entirely adequate to overcome the problem, since they often involve complicated and expensive circuitry and detection devices, and these devices are normally mounted within the vent and are susceptible to damage from small grease fires which sometimes occur within the cooking area. In addition, grease accumulates on such detection devices mounted within the vent and require frequent maintenance to prevent the system from being rendered inoperative by such accumulation of grease.

A need has thus arisen for a practical exhaust ventilation control system which reduces the unnecessary running time for the exhaust fan and the associated increased energy consumption of the system air conditioning the interior of the building. In addition, there is a need for a ventilation control system which dependable to operate, relatively inexpensive, and easy to install.

SUMMARY OF THE INVENTION

The exhaust ventilation control system of the present invention eliminates the unnecessary operation of the exhaust fan, thereby saving power consumed by the exhaust fan motor and more importantly the power loss associated with the building's air conditioning system.

In accordance with the present invention, an exhaust ventilation control system includes a ventilation hood positioned over a cooking station and having ventilation ducting communicating with the outside environment. An exhaust fan removes the by-products of the cooking process from the cooking station through the ventilation hood and associated ducting to the outside. Automatic means responsive to the presence of a cook at the cooking station activates a time delayed off switch for a predetermined period of time, the switch energizes the exhaust fan for the set period of time, thereby operating the exhaust fan system only when a cook is at the cooking station and shutting off the device to conserve energy after the cook has left the cooking station for the predetermined period time.

The exhaust ventilation system of the present invention may include a pressure sensitive switch mounted in a floor mat adjacent the cooking station for operating the time delay switch energizing the fan. In another embodiment, the presence of the cook may be detected by a photoelectric cell for energizing the exhaust fan through the time delay switch.

Another embodiment of the exhaust ventilation control system includes a fresh air fan for introducing outside air in the vicinity of the cooking station to be exhausted along with the cooking fumes, wherein the means responsive to the time delayed switch for energizing the exhaust fan also energizes the fresh air fan and deenergizes for a like predetermined period of time after the cook has left the cooking station.

In still another embodiment of the present invention, an auxiliary fan system having low energy requirements suited for continuous operation is located in a predetermined area of the cooking station. The auxiliary fan is normally on when the exhaust fan and fresh air fans are off and is responsive to said timed switch for being deenergized upon energizing the exhaust and fresh air fans.

BRIEF DESCRIPTION OF THE DRAWINGS

For a more complete understanding of the present invention and further objects and advantages thereof, reference is now made to the following description taken in conjunction with the following drawings.

DESCRIPTION OF PREFERRED EMBODIMENT

Figure 1:
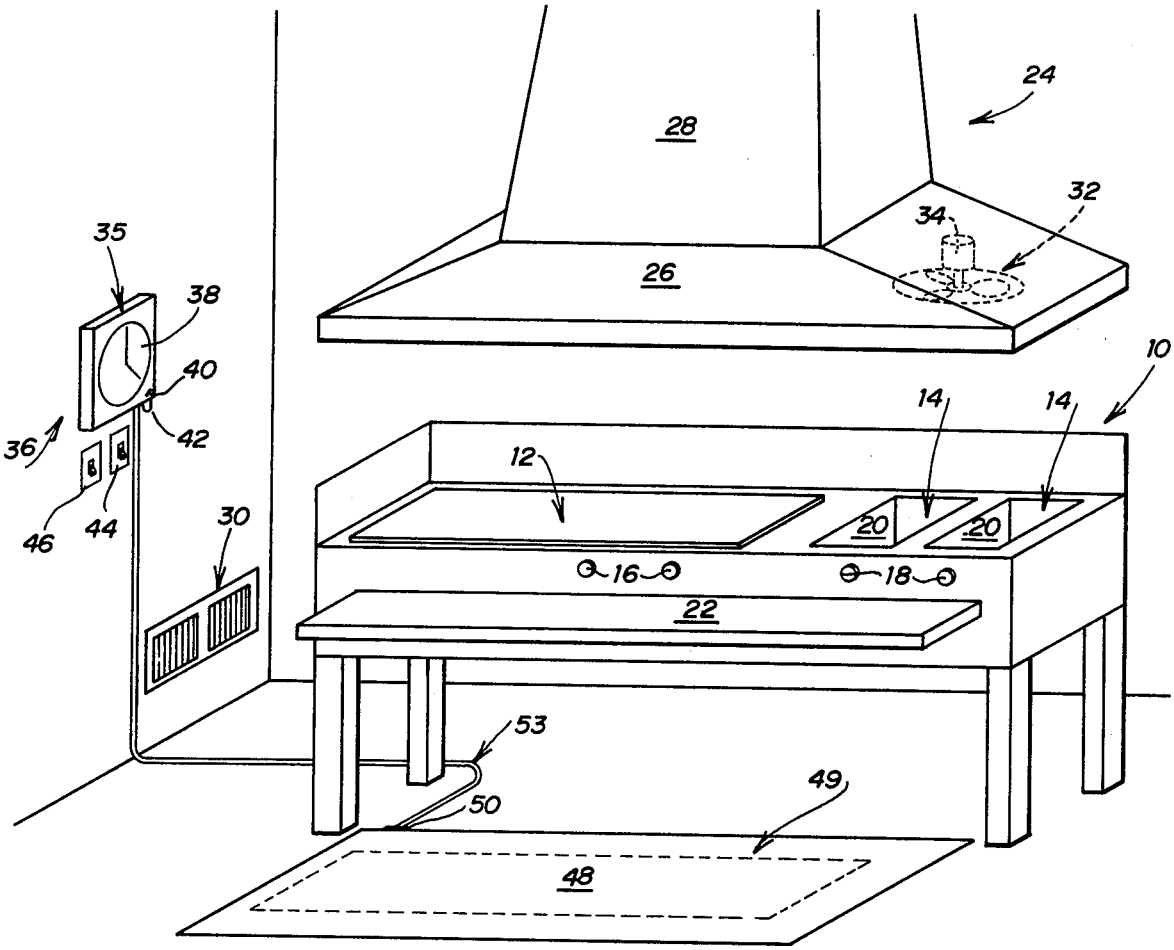
FIG. 1 is a perspective view of the preferred embodiment of the invention.

FIG. 1 shows a conventional cooking station 10 used in many cafeterias and fast food restaurants. The cooking station 10 includes a grill area 12 and frying stations 14. The grilling area 12 has temperature control knobs 16 for adjusting the gas burners (not shown) beneath the grill 12. Temperature control knobs 18 adjust the temperature of the hot grease retained within the wells 20 of the frying stations 14. A work area 22 is normally provided on the front of the cooking station 10 for holding the necessary cooking utensils and food supplies.

An exhaust ventilation ducting system 24 is located directly above the cooking station 10 and includes a vented hood 26 extending over the grill 12 and frying area 14, and a system of duct work 28 for communicating with the outside environment. The exhaust fan (not shown) used in conjunction with such a cooking station 10 is normally located on the roof of the building. An exhaust fan motor of ¾ hp. rating has proven satisfactory in the operation of such commercial exhaust fans. In addition to the exhaust fan, a fresh air blower (not shown) is used in conjunction with the exhaust fan and is also normally mounted on the roof of the building. A motor of ⅓ h.p. rating is sufficient to operate the fresh air fan. The outside air pulled in by the fresh air blower is carried through a separate series of ducting (not shown) and is expelled through a ventilation opening 30 normally situated near the base region of the cooking station 10. When such fresh air blower is in operation, a quantity of outside air is supplied in the vicinity of the cooking station 10 for exhausting with the fumes of the cooking process, thereby reducing the flow of air conditioning being expelled by the exhaust fan.

An auxiliary fan system 32 is housed within the vented hood 26 and located directly above the frying station 14 for eliminating the smoke which is continually being emitted by the heated grease within the frying wells 20. The auxiliary fan motor 34 may be a small 1/100th h.p. rated electric motor having low power requirements suitable for conserving electricity during continuous operation.

Also shown in FIG. 1 is a wall mounted unit 35 for housing the fan control system 36. The fan control system 36 includes a clock 38 which operates only when the exhaust fan motor is energized. In addition, a toggle switch 40 is provided for initially energizing the auxiliary fan system 32, including a pilot light 42 for visually indicating that the auxiliary fan system 32 has been energized. An emergency exhaust fan switch 44 and fresh air fan cutoff switch 46 are also shown mounted on the wall near the fan control system 36. The operation of the fan control switches 40, 44 and 46 will be described in more detail below in connection with the operation of the exhaust fan ventilation system 24.

Also shown in FIG. 1 is a floor mat 48 including pressure sensitive switch means 49 electrically connected via detachable plug 50 through wires 53 to the fan control system 36. The floor mat 48 is positioned adjacent the front of the cooking station 10 where the cook stands when preparing food at the grill area 12 or the fry station 14. The floor mat 48 may be constructed of rubber and is detachable at plug 50 for disconnecting the mat from the control system for cleaning the mat 48.

Figure 2:
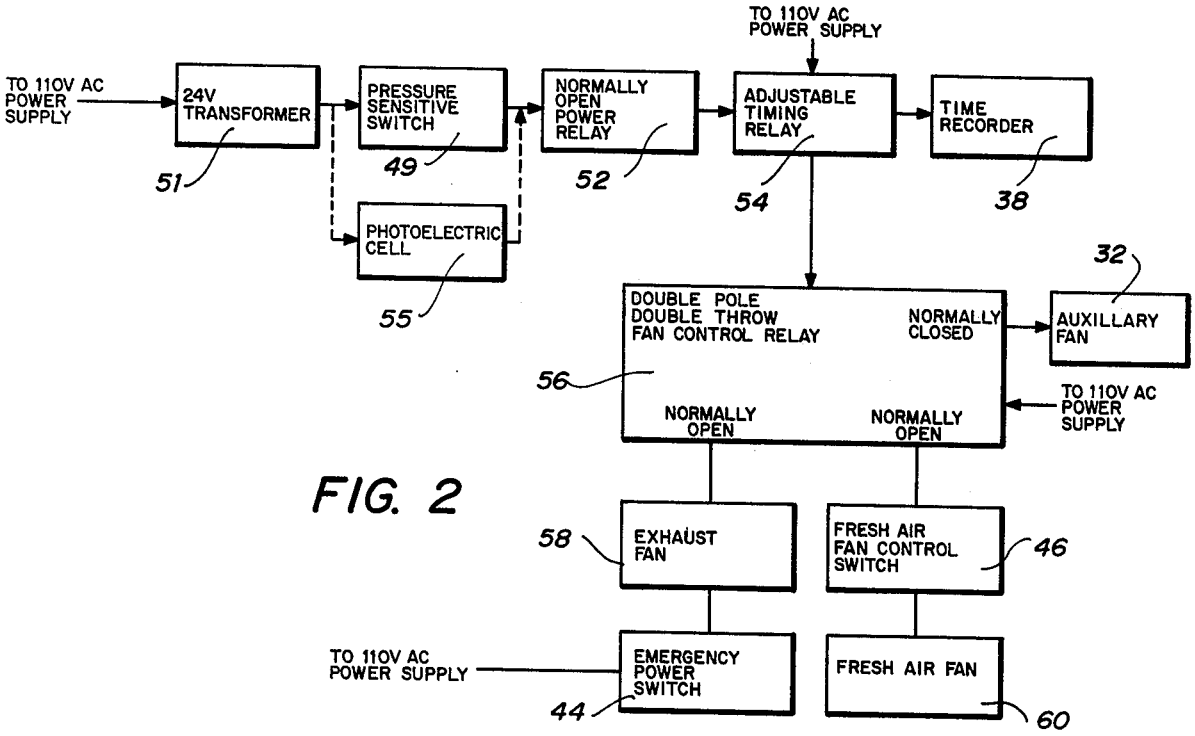
FIG. 2 is a block diagram of the preferred embodiment of the present invention.

FIG. 2 is a block diagram of the exhaust fan control system 36. A 24 volt step down transformer 51 is connected to a standard 110 volt AC power supply for energizing the floor mat pressure sensitive switch 49. Closing the pressure sensitive switch 49 in turn closes the normally open contacts of power relay 52 which energizes the coil of the adjustable time delay relay 54. The time delay relay 54 also energizes the clock 38 to record the amount of time the time delay relay 54 is closed each day.

Alternatively, pressure sensitive switch 49 may be replaced by a photoelectric cell 55 for opening and closing the normally open contacts of power relay 52 in response to the absence or presence of a cook at the cooking station 10.

The time relay 54 is connected to a standard 110 volt AC power line and includes means for adjusting the period of time the time delay relay 54 is energized after the switch 49 is opened. The time delay relay 54 may be set to open its contacts for any desired period of time after switch 49 opens, but the actual operation of the exhaust fan control system 36 shows that it is sufficient to set the timer for two minutes. Thus, the contacts of the time delay relay 54 will open the circuit two minutes after the food preparer has left the floor mat 48, in order to withdraw all of the cooking fumes remaining from the cooking process.

A double pole-double throw fan control relay 56 is shown connected to the time delay relay 54 for controlling the operation of the auxiliary fan system 32, exhaust fan 58, and fresh air fan 60. The auxiliary fan system 32 has the auxiliary fan motor 34 connected to a normally closed contact of the fan control relay 56 for electrically connecting the auxiliary fan 32 to a separate power supply, thereby allowing operation of the auxiliary fan system 32 when the exhaust fan 58 and fresh air fan 60 are off.

The exhaust fan 58 is connected to a normally open contact of fan control relay 56 which closes when the pressure sensitive switch 49 is depressed, thereby energizing time delay relay 54. The exhaust fan 58 runs as long as the cook is standing on the mat 48 depressing the pressure sensitive switch 49, and exhaust fan 58 is turned off by time delay relay 54 a predetermined period of time after the cook has left the cooking station 10. An emergency exhaust fan switch 44 separately connects the exhaust fan 58 to a power supply for operation of the exhaust fan in case of any malfunction of the above-described circuitry. Thus, the exhaust fan 58 may be manually energized at any time to insure that cooking fumes will be exhausted from the interior of the building.

The fresh air fan 60 is connected to a normally open contact of fan control relay 56 through a fresh air fan cutoff switch 46. The fresh air fan 60 has proven to save the energy consumed by the air conditioning system of the building only when the outside air temperature is close to the interior temperature maintained by the thermostat of the air conditioning system. However, when the outside air temperature becomes extremely warm or extremely cool, it has been found desirable to have means to cut off the flow of outside air coming through ventilation opening 30 (FIG. 1).

In operation, the clock 38 is initially set to some arbitrary starting time such as 12 o'clock for convenience in obtaining a reading at the end of the day of the total time the exhaust fan 58 has been operated. The auxiliary fan system 32 is initially energized by closing the toggle switch 40 which is visually indicated to be "on" by the pilot light 42. The emergency exhaust fan switch 44 is normally left in the "off" position when the fan control system 36 is functioning normally. The fresh air fan 60 will be preset by the fresh air fan cutoff switch 46 to be included in the automatic operation of the exhaust system or to be eliminated from such operation, depending upon the outside air temperature. For example, the outside air temperature on an average winter morning would be normally much below the 68°–70° F. temperature controlled by the air conditioning system, and accordingly the fresh air fan 60 would be removed from automatic operation by switching the fresh air fan cutoff switch 46 in the "off" position.

The cook approaching the cooking station 10 to prepare food upon the grill 12 or the frying stations 14 stands upon the floor mat 48 depressing the pressure sensitive switch 49. Closing the pressure sensitive switch 49 in turn closes the contacts of the power relay 52, thereby energizing the time delay relay 54. The normally open contact of time delay relay 54 closes, causing the clock 38 to run and continue to run until the relay 54 has timed out for the preset period of time, usually two minutes, after the cook has left the cooking station 10.

The closing of the adjustable time delay relay 54 energizes the fan control relay 56, opening the normally closed contacts to the auxiliary fan system 32 and closing the normally open contacts to the exhaust fan 58 and fresh air fan 60. Since the fresh air fan cutoff switch 46 is in the "off" position in this example, the motor for the fresh air fan 60 is not energized, but the exhaust fan 58 immediately begins to run and continues to run as long as the contact of fan control relay 56 is closed.

When the cook has finished his job at the cooking station 10 and walks off of the floor mat 48 the switch 49 opens and the contact of power relay 52 opens, but the time delay relay 54 continues to energize the fan control relay 56 from a separate power supply until it "times out." The continued running of the exhaust fan 58 enables the ventilation system to completely remove all cooking fumes lingering in the air around the cooking station 10. When the contact of time delay relay 54 opens, the normally open contacts of fan control relay 56 to the exhaust fan 58 open (and fresh air fan 60 if control switch 46 was in the "on" position) and the normally closed contact to the small auxiliary fan 32 for continued operation closes. Thus, the auxiliary fan system 32 provides for the continuous venting of cooking fumes over the fry stations 14 which are left on and normally continue to produce some small amount of smoke or fumes to be exhausted. The auxiliary fan system 32 does not exhaust the same volume of air from the interior of the building as the exhaust fan 58 does in operation, which amounts to a considerable savings in the air conditioning utility bill in a fast food restaurant which may be open 12 to 24 hours a day.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

What is claimed is:

1. In an exhaust ventilation system for conserving energy lost by exhausting the air conditioning from the interior of a building along with the by-products generated by the process of cooking food at a cooking station, the ventilation system including a ventilation hood positioned over the cooking station and having ducting communicating with the outside environment and an exhaust fan for removing the by-products of cooking food from the area of the cooking station through the ducting of the ventilation system to the outside, the improvement comprising:

exhaust control means connected to the exhaust fan and automatically responsive to the presence and absence of a cook at the cooking station, a timed switch operable in response to said control means to switch to a first position when the cook is present at the area of the cooking station and further operable to switch to a second position a predetermined period of time after the cook leaves the area of the cooking station; and means responsive to the first position of said timed switch and connected to the exhaust fan for energizing the exhaust fan to run and responsive to the second position of said timed switch for deenergizing the exhaust fan.

2. The exhaust ventilation control system of claim 1 wherein said means responsive to the presence of a cook at the cooking station comprises a pressure sensitive switch mounted in a floor mat position adjacent the cooking station.

3. The exhaust ventilation control system of claim 1 wherein said means responsive to the presence of a cook at the cooking station comprises a photoelectric cell.

4. The exhaust ventilation control system of claim 1 wherein said means responsive to said timed switch comprises a relay for electrically connecting said exhaust fan to a source of electrical energy for a predetermined period of time.

5. The exhaust ventilation control system of claim 1 wherein said exhaust control means further comprises:

a fresh air fan for introducing outside air in the vicinity of the cooking station for supplying a volume of air to be exhausted with the said by-products of cooking by said exhaust fan; and said means responsive to said timed switch is connected to said fresh air fan and energizes said fresh air fan until said timed switch opens and deenergizes said fresh air fan.

6. The exhaust ventilation control system of claim 1 further comprising an emergency power switch for energizing said exhaust fan independent of said exhaust control means.

7. The exhaust ventilation control system of claim 5 and further comprising a cut-off switch for disconnecting said fresh air fan from said means responsive to said timed switch, thereby rendering said fresh air fan inoperative during periods of extreme outside air temperature.

8. The exhaust ventilation system of claim 1 and further comprising:

an auxiliary fan system having energy requirement less than said exhaust fan; and said means responsive to said timed switch connecting said auxiliary fan system to a source of power for alternately energizing said auxiliary fan system in conjunction with the operation of said exhaust fan, such that said auxiliary fan system is energized when said exhaust fan is deenergized and vice versa.

9. The exhaust ventilation control system of claim 8 and further comprising switching means for connecting said auxiliary fan to the source of power and visual signal means responsive to energizing said auxiliary fan.

10. The exhaust ventilation control system of claim 1 and further comprising means for recording the operating time of said exhaust fan.

11. An exhaust control system for use in conserving the power consumed by a ventilating system located over a cooking station and having a vented hood, duct work communicating with the outside environment, and an exhaust fan for withdrawing by-products generated by cooking food at the cooking station, wherein the improvement comprises:

exhaust control means connected to the exhaust fan and automatically responsive to the presence and absence of a cook at the cooking station;

a delayed off switch operable in response to said control means to switch to a first position when the cook is present at the area of the cooking station and further operable to switch to a second position a predetermined period of time after the cook leaves the area of the cooking station;

means responsive to the first position of said delayed off switch and connected to the exhaust fan for energizing the exhaust fan to run and responsive to the second position of said timed switch for deenergizing the exhaust fan; and an auxiliary fan system having operating energy requirements less than the exhaust fan and located within the vented hood of the ventilation system and controlled by said means responsive to said delayed off switch for normally operating said auxiliary fan system through a separate power supply when the exhaust fan is off and deenergizing said auxiliary fan system when the exhaust fan system is energized.

12. The exhaust ventilation control system of claim 11 wherein said means responsive to the presence of a cook at the cooking station is a pressure sensitive switch mounted in a region adjacent the cooking station.

13. The exhaust ventilation control system of claim 11 wherein said means responsive to the presence of a cook at the cooking station is a photoelectric cell.

14. The exhaust ventilation control system of claim 11 wherein the exhaust control means further comprises:

a fresh air fan for introducing a flow of outside air into the vicinity of the cooking station; and said means responsive to said delayed off switch is connected to said fresh air fan and energizes said fresh air fan in conjunction with energizing said exhaust fan until said timed switch opens and deenergizes said fresh air fan.

15. The exhaust ventilation control system of claim 11 and further comprising means for recording the total operating time for said exhaust fan.

* * * * *